US006659271B2

(12) United States Patent
Parsons

(10) Patent No.: US 6,659,271 B2
(45) Date of Patent: Dec. 9, 2003

(54) GIFT PACKAGE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 17 days.

(21) Appl. No.: 09/847,150

(22) Filed: May 2, 2001

(65) Prior Publication Data

US 2002/0162757 A1 Nov. 7, 2002

(51) Int. Cl.[7] ..... B65D 69/00
(52) U.S. Cl. ..... 206/232; 206/459.5
(58) Field of Search ..... 206/232, 459.5, 206/755–778, 782, 783, 349, 587–590

(56) References Cited

U.S. PATENT DOCUMENTS

| | | | | |
|---|---|---|---|---|
| 2,269,589 A | | 1/1942 | Kaufman | |
| 2,826,844 A | | 3/1958 | Leika | |
| 4,286,399 A | | 9/1981 | Funahashi et al. | |
| 4,363,081 A | | 12/1982 | Wilbur | |
| 4,497,126 A | | 2/1985 | Dejean | |
| 4,739,353 A | * | 4/1988 | Heuer et al. | 206/776 |
| 5,038,930 A | * | 8/1991 | Holtkamp, Jr. | 206/232 |
| 5,197,599 A | | 3/1993 | Dolan | |
| 5,232,087 A | * | 8/1993 | Schluger | 206/232 |
| 5,409,105 A | * | 4/1995 | Appelbaum et al. | 206/777 |
| 5,469,965 A | * | 11/1995 | Stearns | 206/523 |
| 5,497,876 A | * | 3/1996 | Fleming | 206/232 |
| 5,575,384 A | | 11/1996 | Saye | |
| 5,611,426 A | * | 3/1997 | Warfield | 206/778 |
| 5,641,062 A | * | 6/1997 | Burton et al. | 206/232 |
| 5,794,631 A | * | 8/1998 | Sylvester | 206/232 |
| 6,070,719 A | * | 6/2000 | Pollock | 206/232 |

* cited by examiner

*Primary Examiner*—Luan K. Bui
(74) *Attorney, Agent, or Firm*—Welsh & Katz, Ltd.

(57) ABSTRACT

The present invention is directed to packaging for a product. The packaging includes a tray for carrying the product, and a card for covering and containing the tray, wherein the card includes a first panel that is folded over a second panel to form an inner compartment therebetween for containing the tray, and a third panel that serves as a cover and is folded over the inner compartment.

4 Claims, 3 Drawing Sheets

FIG. 3
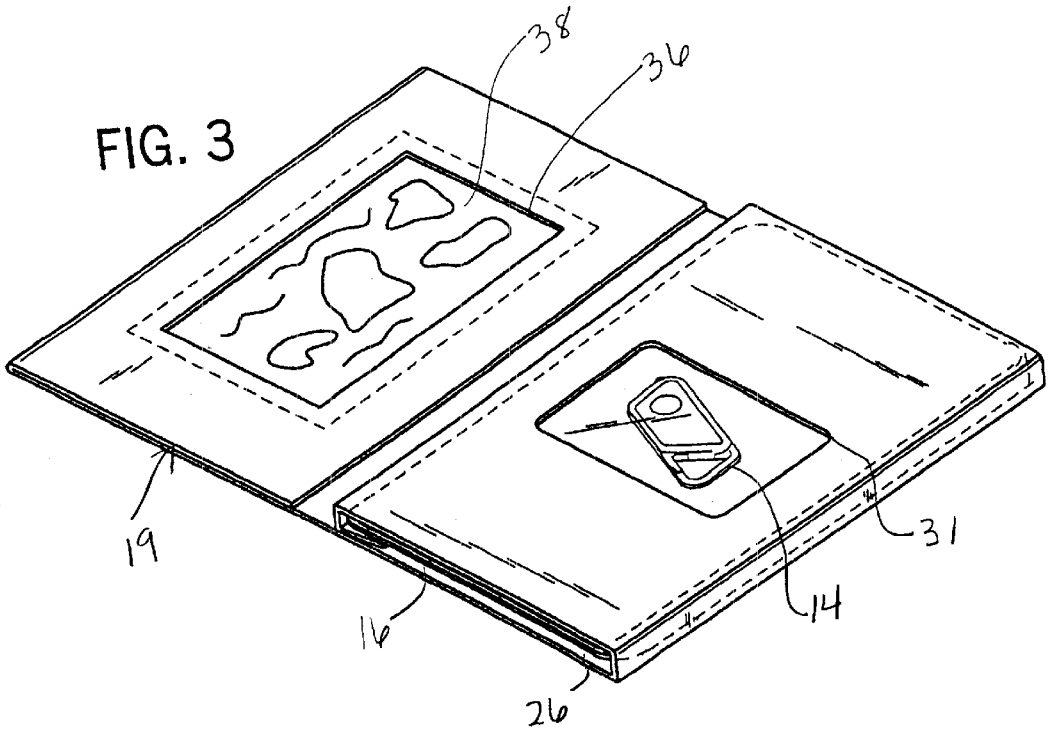
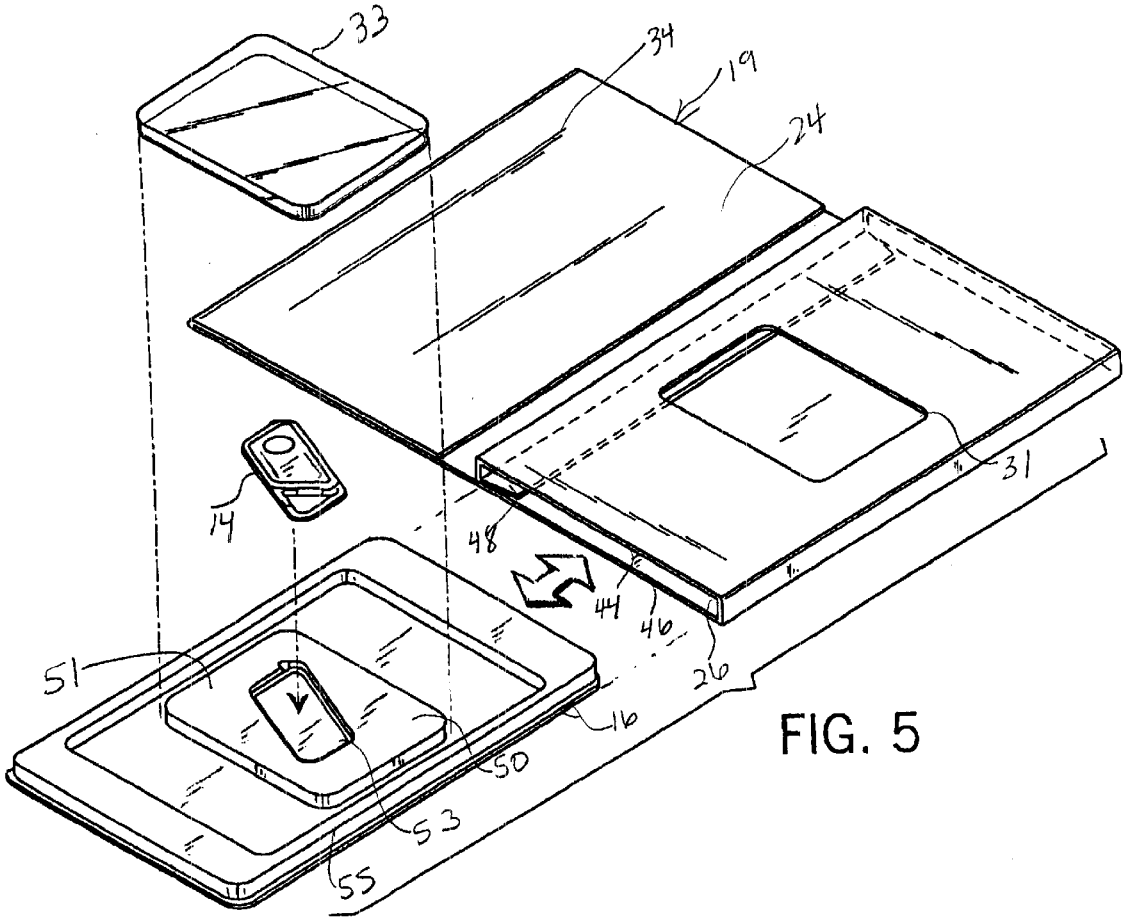
FIG. 5

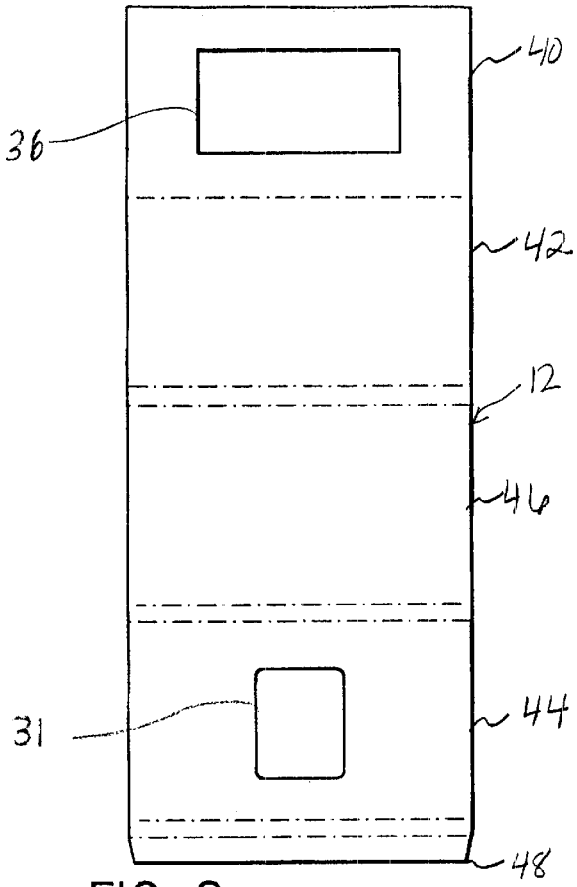
FIG. 8
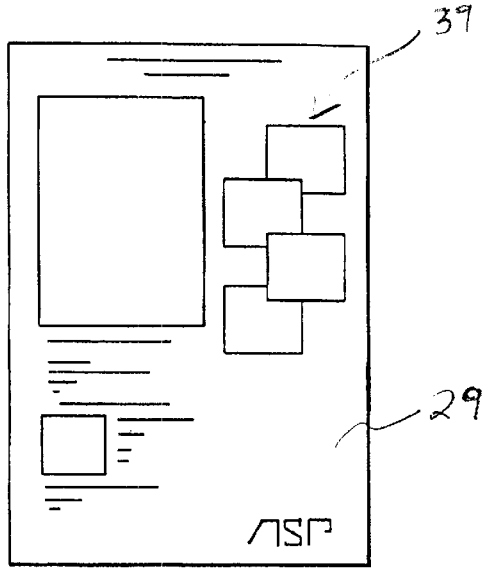
FIG. 4
FIG. 6
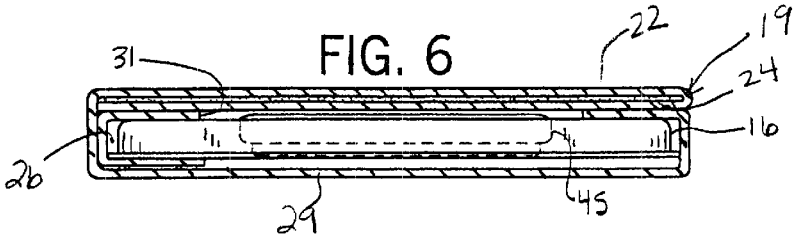
FIG. 7
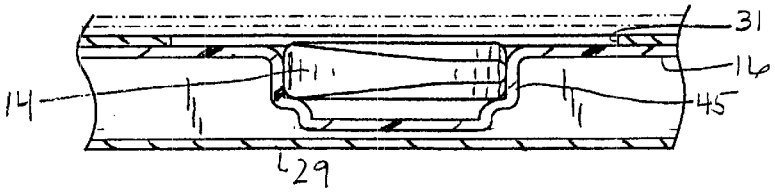

GIFT PACKAGE

FIELD OF THE INVENTION

The present invention is directed to product packaging that serves as the primary protective packaging for a product contained therein, yet also serves as gift packaging that allows the product to be presented as a gift in a distinctive and stylish manner.

BACKGROUND OF THE INVENTION

Over the years it has become a common practice to provide gifts to valued employees, clients, customers, and business associates. These gifts may serve as tokens of appreciation from a grateful boss or business associate. Often, the gifts may be provided with the logo of the company sending the gift. Providing gifts with a company logo has been found to be a particularly effective marketing tool where the gift is a useful item, such as a keychain, or flashlight, that is carried by the recipient throughout the day. The recipient of the gift is reminded of the generosity of the gift-giver each time the gift is used. This serves to generate good will and the company that gave the gift remains in the minds of the gift recipients.

Similarly, it has also become a common practice to present cards, such as "Thank You" cards, cards commemorating a holiday or other events, such as graduation, as well as cards providing inspirational messages. Often, it is desirable to provide a gift, as well as an explanatory card including a message that explains the reason for the gift. For example, a gift may be given along with a card having the message "Thank you for your business." Cards of this type were typically mailed to the intended recipient, and may have been accompanied by a separately packaged gift.

In the past, packaging of small items, such as gifts, typically included the use of a clamshell package or a gift box including a foam core. Both of these approaches, however, had their shortcomings. Since clamshells tend to be unsightly, consumers are hesitant to send them as gifts. To do so, consumers must remove the item from the clamshell and repackage the item. As for gift boxes, although a gift box can be presented as a gift, the foam core that oftentimes carries the item is very expensive to manufacture. In addition, if the gift sender were also planning to a send a card, then the card and gift would have to be repackaged in a common envelope or package. This required additional effort on the part of the gift sender, and the resulting package received by the recipient was not particularly impressive or memorable.

Thus, there is a need in the prior art for packaging that enables the item contained therein to be presented as a gift. In other words, there is a need to provide packaging that functions as the primary protective packaging for the product and also serves to present the product as a gift. Further, there is a need for giftable packaging that can be inexpensively manufactured.

SUMMARY OF THE INVENTION

The present invention recognizes the current trend of businesses that provide gifts or promotional items to valued employees, customers, clients, and business associates. The present invention is directed to providing the primary protective packaging for a product contained therein, in a package that also serves to present the product as a gift. The present invention meets the shortcomings of the prior art by providing packaging that allows the item contained therein to be presented as a gift. In a preferred embodiment, the packaging includes a tray for carrying the product, and a card for covering and containing the tray. The tray preferably comprises a sturdy, crushproof surface for supporting the product that can be easily accommodated within an inner compartment of the card. The inner compartment of the card may advantageously include a cut-out portion or window, that allows the product to be placed in the tray, within the inner compartment of the card, yet remain visible to allow the recipient of the card to immediately view the gift once the package has been opened. A plastic window may be placed over the cut-out portion to allow the product to be showcased within the card. The plastic window may be a clear cover placed over the tray, or portion of the tray, or an inset glued to the inside of the inner compartment. Preferably, the tray includes a raised portion surrounding the product over which the clear lid may be positioned and secured in place. Regardless of its construction, the plastic window, or clear cover, allows the product to be viewed, but protects the product by preventing it from falling out of the tray, or protecting the product from being removed from the card if the card is on display.

The card may further include a panel that is folded over the inner compartment and the product carried within the tray. Thus, the packaging may operate in a fashion similar to that of a greeting card. Either the inside or outside surface of the folded panel (or both) may include a message, such as inspirational message, advertising, a word of thanks, a holiday greeting, or any other message suitable for including on the card. Further, the card may be provided with a cut-out portion to accommodate a photo or a business card.

Thus, the embodiments of the present invention allow one to present a gift in its primary protective packaging, in a manner that allows the package to be opened like a greeting card and contain a variety of messages. The packaging protects the product during shipment, and also serves as a convenient and presentable format to present a gift. In particular, the crushproof tray positioned within an inner compartment of the card, allows the package to be easily transported through the mail, like a greeting card, while protecting the product and maintaining the integrity of the card. In addition, the present invention may eliminate the need to send a separate card along with the gift, because the packaging not only may serve as the protective packaging for the product, but as a card as well. Thus, the packaging is a usable package that may serve as both product protector and greeting card, and may eliminate the need to wrap a separate package including the product and message. Moreover, the packaging is easily prepared for sending through the mail and may be sent as easily as an oversized envelope. Furthermore, the card may be made using a unitary piece of cardboard, or other suitable stock, and the tray may be made of thermoformed plastic. Thus, the packaging of the present invention can be produced by automated machinery, allowing the card to be made inexpensively in comparison with separate boxing. This packaging brings about a simplification in manufacturing and therefore a substantial saving in manufacturing costs.

BRIEF DESCRIPTION OF THE DRAWINGS

FIG. 3 is a perspective view of an alternate embodiment of the present invention shown in its open position.

FIG. 4 is a back view of the packaging of the present invention.

FIG. 5 is an exploded view of the packaging of the present invention.

FIG. 6 is a cross-sectional view taken along line 6—6 of FIG. 1.

FIG. 7 is a cross-sectional view taken along line 7—7 of FIG. 2.

FIG. 8 is a top view of an unassembled card of the present invention.

DETAILED DESCRIPTION OF THE INVENTION

Packaging made in accordance with the principles of the present invention is depicted in FIGS. 1–8. The packaging 10 generally comprises a card 12 for containing a product 14 and a tray 16 for carrying the product 14.

Figure 1:
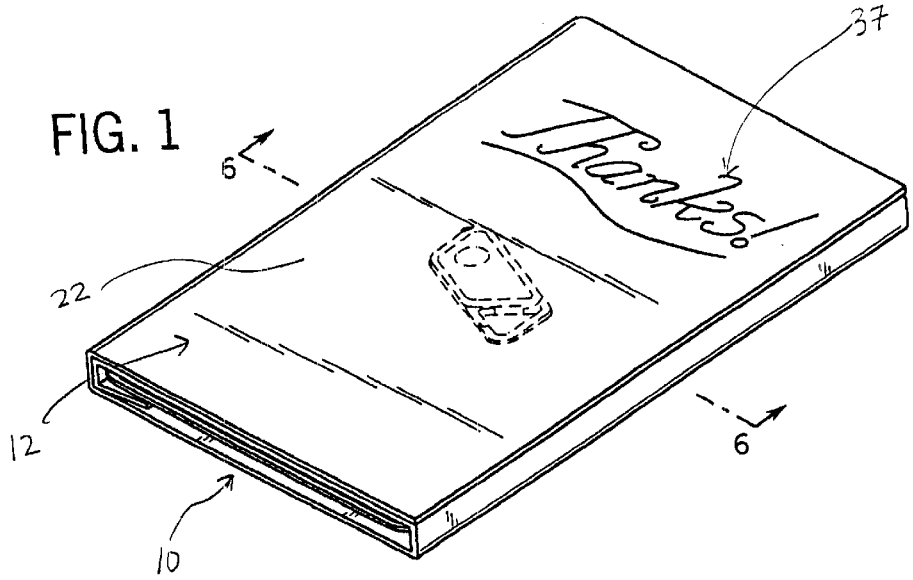
FIG. 1 is a perspective view of packaging made in accordance with the principles of the present invention.
Figure 2:
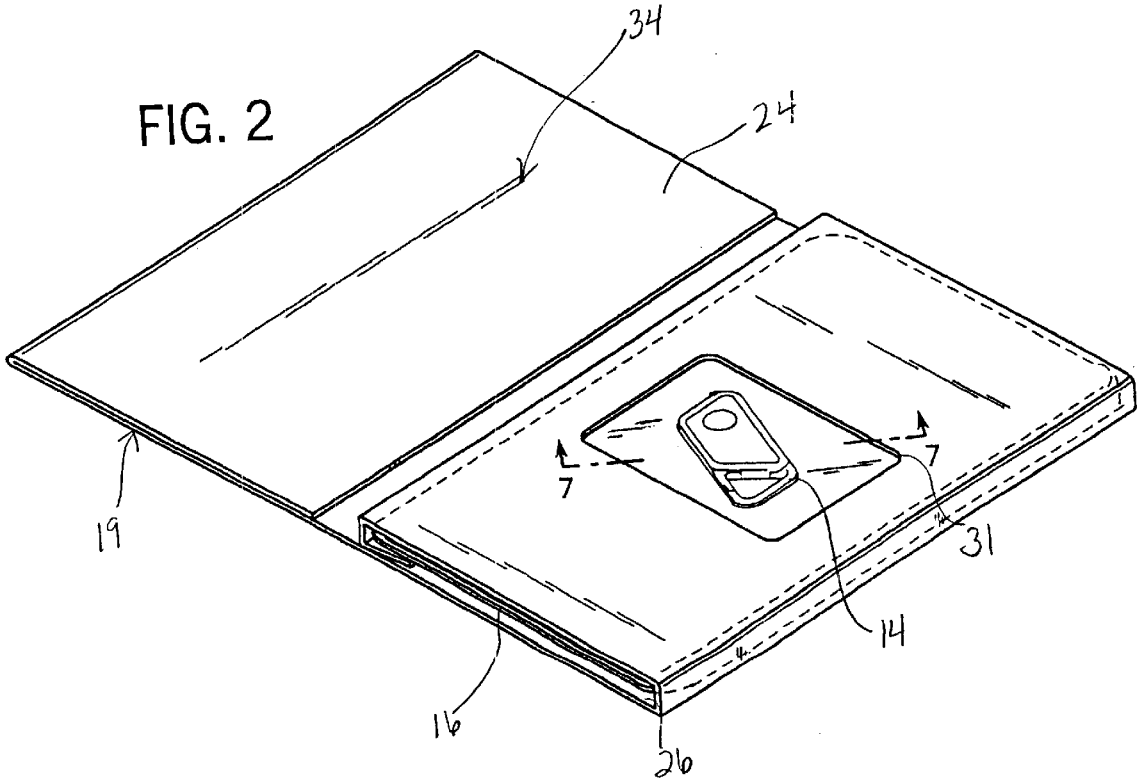
FIG. 2 is a perspective view of the packaging of FIG. 1 shown in its open position.

Referring to FIGS. 1, 2, and 4, the card 12 includes a cover 19 with an outside surface 22 and an inside surface 24, an inner product compartment 26 for containing the product 14, and a bottom surface 29. In the closed position of FIG. 1, the cover 19 lays over the inner compartment 26, thereby protecting the product 14 contained therein. The cover 19 can be flipped to an open position, shown in FIG. 2, to expose the inside surface 24 and the product compartment 26. The product compartment 26 may further include a window 31 for viewing the product 14 and a layer of protective material 33 positioned between the window 31 and the product 14. The layer of protective material may comprise clear plastic, cellophane, or other translucent material. In one embodiment, an adhesive may be used to affix the clear protective material to an inner surface of compartment 26. Most preferably, however, in reference to FIG. 5, the protective material layer 33 takes the form of a clear plastic lid that is placed over a raised portion 50 of the tray. The clear plastic lid encloses the raised portion and is thereby secured in place. The clear plastic lid serves as a protective window that ensures that the product 14 is maintained in cavity 53 during both shipment and display. Further, the clear plastic lid, preferably a thermoformed plastic, provides a glossy appearance to the product 14 within the compartment, thereby enhancing the presentation of the product and showcasing the product as a gift. Thus, the clear plastic lid serves to protect the product during shipment and display, maintains the product in place, and provides an improved presentation, similar to showcasing a product under glass.

The cover 19 of the present invention has several functions. In its closed position, as shown in FIG. 1, the cover 19 helps to hold the product 14 contained in the product compartment 26 in place. The cover 19 also protects the product 14 from damage during shipping or while on display.

Different embodiments of the cover 19 are contemplated. Referring to FIG. 2, the inside surface 24 may include a graphic 34 from any number of categories, including business, motivation, holidays, travel destinations or important locations. Alternately, as shown in FIG. 3, the inside surface 24 may be provided with a cut-out portion 36, through which a photo 38 can be placed and viewed. Of course, the outside surface 22 instead may be provided with a cut-out portion (not shown) for a photo. Further, any surface of the card 12 may include a cut-out portion in which a business card or photograph may be inset.

The cover 19 may be provided with advertising related to the product 14 contained therein. For example, if the advertising is associated with a particular business, the product 14 could be personalized to thank a customer for his continued support. Alternately, the cover 19 can include a holiday greeting or an inspirational message. Similarly, the inside surface 24 may also be provided with advertising, greetings, or messages. The bottom surface 29, as can be seen in FIG. 4, may include advertising or other information 39 regarding the product 14.

The card 12 is preferably constructed of a single piece of heavy-duty paperboard or a specialized paper such as leather grain, metallic finish, linen textures, wood grain, or simulated stone. In a preferred embodiment, the card is made of Solid Bleached Sulfide ("SBS") paperboard. The card 12 in its unassembled state is shown in FIG. 8. To form the product compartment 26, a first panel 44 is folded over a second panel 46 while leaving sufficient distance to accommodate the tray 16 therebetween. Then a flap 48, which is integral with the free, unfolded end of the first panel 44, is folded under and attached to the second panel 46, as shown in FIG. 5. The product compartment 26 can be collapsed by moving the first panel 44 towards the second panel 46. Since the product compartment 26 can be collapsed, the card 12 can take a flat profile, thereby allowing it to be easily customized by foil stamping or on a letter press. Further, the flat profile of the card 12 facilitates its storage and stacking. The card may be constructed in known fashion using automated gluing or taping machines.

To form the cover 19, a fourth panel 40 is folded over onto a third panel 42 and affixed thereto. Alternately, the third panel 42 could alone serve as the cover. The tray 16 preferably comprises a flocked styrene surface 51 with a cavity 53 shaped to accommodate a specific product. The flocked surface 51 provides a tight fit between the product 14 and the cavity 53, and secures the product 14 therein. The advantage that results from the presence of a flocked surface is that the fibers of the flocking are "crushed" when the product 14 is inserted and as a result hold the product 14 in place in the cavity 53. This allows the cards to be mailed without the product being dislodged. In contrast, if the cavity 53 were made of a smooth plastic material, it would not hold the product 14 in place during shipment. Also, other materials suitable to hold the product in place, such as die cut foam, could be used in place of the flocked styrene.

The tray 16 preferably extends the entire length of the product compartment 26 to prevent the card 12 from collapsing. The tray 16 is preferably made by a thermoforming process, includes raised ribs, and thus is crushproof. As can be seen in FIG. 5, the tray 16 is reinforced with ribs 55 to support the card 12 and further prevent it from collapsing during transport.

To assemble the packaging 10, the card is assembled as described above. The product 14 is then placed within the cavity 53 of the tray 16. The tray 16, in turn, is slid into the product compartment 26 so that the product 14 can be seen through the window 31. Once the cover 19 is flipped closed to cover the product compartment 26, the packaging 10 is then ready to be displayed or shipped.

The card 12 of the present invention provides a safe shipping package for products that is not expensive to manufacture. In fact, the use of the collapsible product compartment 26 in combination with the flocked tray 16 makes the card 12 reasonable to produce from a cost standpoint. The construction of both the card 12 and the tray 16 allows the packaging 10 to be manufactured entirely by automated machinery, thereby bringing about a substantial saving in manufacturing costs.

The figures depict the product 14 contained in the card 12 as a SAPPHIRE flashlight, available from Armament Systems and Procedures, Inc., Appleton, Wis. Alternately, the product 14 carried by the tray 16 could be a medallion, such as the die struck medallion available from Armament Systems and Procedures. Thus, the shape of the cavity 47 of the tray 16 varies, depending upon the product 14 to be carried.

While the invention has been described in connection with certain embodiments, it should be understood that it is not intended to limit the invention to these particular embodiments. To the contrary, it is intended to cover all alternatives, modifications and equivalents falling within the spirit and scope of the invention.

What is claimed is:

1. Packaging for a product consisting of:

a tray for carrying the product, the tray defining a product display portion;

a transparent cover for covering the product display portion of the tray; and a card for covering and containing the tray, the card including a first panel that is folded over a second panel to form an inner compartment therebetween for containing the tray, the inner compartment defining a window having an area smaller than the display portion of the tray so as to allow viewing a product carried by the tray and securing the transparent cover to the tray when the transparent cover is placed on the display portion of the tray and the tray is placed within the inner compartment, the card including a third panel that serves as a cover, the cover having a first default position when it covers the inner compartment and a second open position when the cover is raised and the inner compartment is exposed, the third panel disposed to remain in the first closed position, over the inner compartment formed by the first and second panels, without locking means.

2. The packaging of claim 1 wherein the transparent cover is made of plastic.

3. The packaging of claim 1 wherein the transparent cover comprises a top surface having a dependent skirt disposed to fit about the display portion of the tray.

4. The packaging of claim 1 wherein the display portion of the tray comprises a platform having a cavity for accommodating a product, the platform having a particular footprint of a desired area, the window in the inner compartment defining a shape similar to the footprint of the platform covering a smaller area.

* * * * *